US006220689B1

(12) United States Patent
Sturgeon

(10) Patent No.: US 6,220,689 B1
(45) Date of Patent: Apr. 24, 2001

(54) UNITARY CAPPING SYSTEM FOR MULTIPLE INKJET PRINTHEADS

(75) Inventor: Scott D. Sturgeon, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/104,274

(22) Filed: Jun. 24, 1998

(51) Int. Cl.[7] ..... B41J 2/165
(52) U.S. Cl. ..... 347/29
(58) Field of Search ..... 347/29, 23, 32

(56) References Cited

U.S. PATENT DOCUMENTS

| | | | | |
|---|---|---|---|---|
| 5,027,134 | * | 6/1991 | Harmon et al. | 347/29 |
| 5,426,456 | | 6/1995 | Kuelzer et al. | 347/30 |
| 5,448,270 | | 9/1995 | Osborne | 347/29 |
| 5,534,896 | * | 7/1996 | Osborne | 347/29 |
| 5,585,826 | * | 12/1996 | Schroeder et al. | 347/29 |
| 5,621,441 | | 4/1997 | Waschhauser et al. | 347/33 |
| 5,712,668 | | 1/1998 | Osborne et al. | 347/32 |
| 5,867,184 | | 2/1999 | Quintana | 347/29 |
| 5,956,053 | | 9/1999 | Michael | 347/29 |
| 5,980,018 | | 11/1999 | Taylor et al. | 347/31 |
| 6,132,026 | | 10/2000 | Taylor et al. | 347/32 |

FOREIGN PATENT DOCUMENTS

| | | | | |
|---|---|---|---|---|
| 0622199 | | 11/1994 | (EP) . | |
| 404014461 | * | 1/1992 | (JP) | 347/29 |
| 09070981 | | 3/1997 | (JP) . | |
| WO98/18634 | | 5/1998 | (WO) | B41J/2/165 |

OTHER PUBLICATIONS

Commonly–assigned, co–pending U.S. application Ser. No. 08/667,610; filed Jul. 3, 1996, entitled "Translating Service Station System for Inkjet Printheads" Patented on Nov. 9, 1999, Pat. No. 5,980,018.

Commonly–assigned, co–pending U.S. application Ser. No. 08/808,366; filed Feb. 28, 1997, entitled "High Deflection Capping System for Inkjet Printheads" Patented on Sep. 21, 1999, Pat. No. 5,956,053.

Commonly–assigned, co–pending U.S. application Ser. No. 08/667,611; filed Jul. 3, 1996 entitled "Integrated Translational Service Station for Inkjet Printhead" Patented on Oct. 17, 2000, Pat. No. 6,132,026.

Commonly–assigned, co–pending U.S. application Ser. No. 08/906,274; filed Aug. 5, 1997, entitled "Rotary Multi–Ridge Capping System for Inkjet Printheads" Patent Pending.

Commonly–assigned, co–pending U.S. application Ser. No. 08/566,221 filed Nov. 30, 1995 entitled "Universal Cap for Different Style Inkjet Printheads" Patented on Feb. 2, 1999, Pat. No. 5,867,184.

European Search Report dated Dec. 17, 1999, for related European patent application 99304738.0–2304, filed Jun. 17, 1999.

* cited by examiner

*Primary Examiner*—N. Le
*Assistant Examiner*—Shih-Wen Hsieh
(74) *Attorney, Agent, or Firm*—Flory L. Martin

(57) ABSTRACT

A unitary capping system for simultaneously sealing multiple inkjet printheads during periods of inactivity has a base, a sled and an elastomeric printhead sealing structure. The base defines a cap hole and a chamber which receives the sled. The sled has a planar surface that moves between sealing and rest positions. The sealing structure has a planar web sandwiched between the sled and the base inside the chamber. The sealing structure has a lip support surrounded by the web, with the lip support having an upper surface extending through the cap hole to encircle the printhead nozzles when the sled is in the sealing position. A deflection cavity is defined between the lip support and the sled planar surface, so a portion of the lip support may collapse into the deflection cavity when sealing the associated printhead. Vent troughs linking two or more supports are defined by the sled planar surface.

19 Claims, 6 Drawing Sheets

UNITARY CAPPING SYSTEM FOR MULTIPLE INKJET PRINTHEADS

FIELD OF THE INVENTION

The present invention relates generally to inkjet printing mechanisms, and more particularly to a unitary capping system for simultaneously sealing multiple inkjet printheads during periods of inactivity.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies, fabric and other media.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote stationary location within the printer. Since these permanent or semi-permanent printheads carry only a small ink supply, they may be physically more narrow than their predecessors, the replaceable cartridges. Narrower printheads lead to a narrower printing mechanism, which has a smaller "footprint," so less desktop space is needed to house the printing mechanism during use. Narrower printheads are usually smaller and lighter, so smaller carriages, bearings, and drive motors may be used, leading to a more economical printing unit for consumers. There are a variety of advantages associated with these off-axis printing systems, but the permanent or semi-permanent nature of the printheads requires special considerations for servicing.

The caps in these earlier service station mechanisms typically included an elastomeric sealing lip supported by a movable platform or sled. Typically, provisions were made for venting the sealing cavity as the cap lips are brought into contact with the printhead. Without a venting feature, air could be forced into the printhead nozzles during capping, which could deprime the nozzles. A variety of capillary passageway venting schemes are known to those skilled in the art, such as those shown in U.S. Pat. Nos. 5,027,134; 5,216,449; and 5,517,220, all assigned to the present assignee, the Hewlett-Packard Company. In the past, a separate vent path was used for each individual cap, often including a separate vent plug for each cap, which contributed to increasing the total part count for a printing mechanism, resulting in a more costly product in terms of both material and labor costs. Another vent system, first sold by the Hewlett-Packard Company in the DeskJet® 693C model color inkjet printer, provided a vent channel in a spring-biased cap base, over which an elastomeric cap was stretched into place.

For two-pen printers, earlier cap sleds were often produced using high temperature thermoplastic materials or thermoset plastic materials which allowed the elastomeric sealing lips to be onsert molded onto the sled. The elastomeric sealing lips were sometimes joined at their base to form a cup-like structure, whereas other cap lip designs projected upwardly from the sled, with the sled itself forming the bottom portion of the sealing cavity. Unfortunately, the systems which used a portion of the sled to define the sealing cavity often had leaks where the cap lips joined the sled. To seal these leaks at the lip/sled interface, higher capping forces were used to physically push the elastomeric lip into a tight seal with the sled. This solution was unfortunate because these higher capping forces may damage, unseat or misalign the printheads, or at the vary least require a more robust printhead design which is usually more costly. Moreover, while suitable for sealing two printheads using a single sled, the onsert molded designs were incapable of providing the wide deflection range required to use a single sled to seal more printheads, and in particular, four closely spaced printheads in an off-axis system.

A reliable capping system must accommodate for tolerance variations in the components of a printhead carriage, as well as variations in the fit of the pens when installed in the carriage. To properly align the pens for printing, each pen is constructed with a set of alignment datums which are tightly seated against a set of corresponding datums on the carriage. Even minor excursions from nominal values for these datums can impact the position of the printhead relative to the cap. Moreover, even if the datums are all within acceptable tolerance norms, occasionally a pen is not fully seated against a carriage datum, leading to tilted and/or twisted printhead orifice plates. A reliable capping system must be robust enough to adapt to these datum and pen seating variations.

Capping systems also need to provide an adequate seal while accommodating several different types of variations in individual printheads. For example, today's printhead orifice plates often have a waviness or ripple to their surface contour because commercially available orifice plates unfortunately are not perfectly planar. Besides waviness, these orifice plates may also be slightly bowed in a convex, concave or compound (both convex and concave) configuration. The waviness property may generate a height variation of up to 0.05–0.08 millimeters (2–3 mils; 0.002–0.003 inches). These orifice plates may also have some inherent surface roughness over which the cap must seal.

The typical way of coping with both the waviness problem and the surface roughness problem is through elastomer compliance, where a soft material is used for the cap lips. The soft cap lips compress and conform to seal over these irregularities in the orifice plate. Unfortunately, some printheads have widely varying maximum and minimum tolerances which mere elastomer compliance is unable to accommodate, so separate spring-biased gimballing cap sleds were required to seal each printhead, such as in the new off-axis style model 2000C inkjet printer produced by the Hewlett-Packard Company. These separate gimballing cap sleds increased the part count, as well as the labor time required to assemble the product, leading to more expensive printing mechanisms.

Rather than relying solely on elastomer compliance, where the elastomer is compressed to varying degrees during capping to ensure a tight seal, one earlier design used a suspended lip configuration, as shown in U.S. Pat. No. 5,448,270, assigned to the Hewlett-Packard Company, the present assignee. In this suspended lip design, a single sealing lip projected upwardly from a suspension-bridge like support. In this design, a hollow channel was formed along the underside of the cap to provide an air pocket down into which the "bridge" portion of the cap could be deflected when the lip required more compression to accommodate for manufacturing tolerance extremes than could be accommodated by mere elastomer compression.

In this suspended lip design, separate caps for each printhead were fit over four separate race or boss structures, sometimes referred to as a "chimneys," all formed on a single cap sled. Each boss served to locate the associated cap in position for sealing a printhead. Each boss had a central channel to provide additional room for the bridge portion to deflect downwardly for maximum desired deflection. Unfortunately, the separate caps required for each printhead further increased the part count for the unit, while also increasing the assembly costs because each cap had to be separately stretched over its boss on the sled. This stretching was required so in a relaxed state, the cap would resiliently grip the boss to provide the desired levels of diffusion resistance and venting. Moreover, because each cap is stretched and press-fit over its boss, cap-to-sled locating accuracy was more difficult to maintain than with onsert molded caps discussed above. The use of the boss to support the caps was believed to be a necessary component of the suspended lip design to adequately support the lip during sealing and ensure proper sealing forces, as well as to properly locate the lip around the printhead nozzles.

Proper capping requires providing an adequate hermetic seal without applying excessive force which may damage the delicate printheads or unseat the pens from their locating datums in the carriage. Moreover, it would be desirable to provide such a capping system which is easier to manufacture than earlier capping systems to provide consumers with a more economical, high quality inkjet printing mechanism.

SUMMARY OF THE INVENTION

According to one aspect of the present invention, a unitary capping system is provided for sealing ink-ejecting nozzles of an inkjet printhead in an inkjet printing mechanism during periods of printing inactivity. The unitary capping system has a base defining a chamber and a cap hole through the base. A sled is received within the base chamber. The sled has an upper planar surface, with the sled moving between a sealing position and a rest position. The unitary capping system also has an elastomeric printhead sealing structure which includes a planar web sandwiched between the sled and the base inside the chamber. The printhead sealing structure also has a hollow lip support surrounded by the web. The lip support has an upper surface extending through the cap hole to encircle the printhead nozzles, with a lip supported by the lip support upper surface to surround the nozzles when the sled is in the sealing position. The hollow lip support and the web each have a lower surface that rests against the upper planar surface of the sled.

According to another aspect of the present invention, a unitary capping system for sealing ink-ejecting nozzles of plural inkjet printheads in an inkjet printing mechanism is provided. The unitary capping system has a sled which is moveable between a sealing position and a rest position. The sled has a planar surface. An elastomeric printhead sealing structure is supported by the sled. The printhead sealing structure has plural lip supports each of which is associated with one of the plural inkjet printheads. Each lip support has opposing first and second surfaces with a sealing lip projecting from the first surface of each lip support. Each sealing lip is configured to surround the nozzles of an associated printhead when the sled is in the sealing position. The second surface of each lip support cooperates with the sled planar surface to define a deflection cavity between the sled and the lip support, so a portion of the lip support may collapse into the deflection cavity when sealing the associated printhead.

According to a further aspect of the present invention, an inkjet printing mechanism may be provided with a unitary printhead capping system as described above.

An overall goal of the present invention is to provide an inkjet printing mechanism which prints sharp vivid images over the life of the printhead and the printing mechanism, particularly when using fast drying pigment or dye-based inks, and preferably when dispensed from an off-axis system or other printing systems using permanent or semi-permanent printheads.

Another goal of the present invention is to provide a unitary capping system for an inkjet printing mechanism that prolongs printhead life.

Still another goal of the present invention is to provide a unitary capping system for sealing printheads in an inkjet printing mechanism, with the system having fewer parts that are easier to manufacture and assemble than earlier systems, and which thus provides consumers with a reliable, economical inkjet printing unit.

DETAILED DESCRIPTION OF A PREFERRED EMBODIMENT

Figure 1:
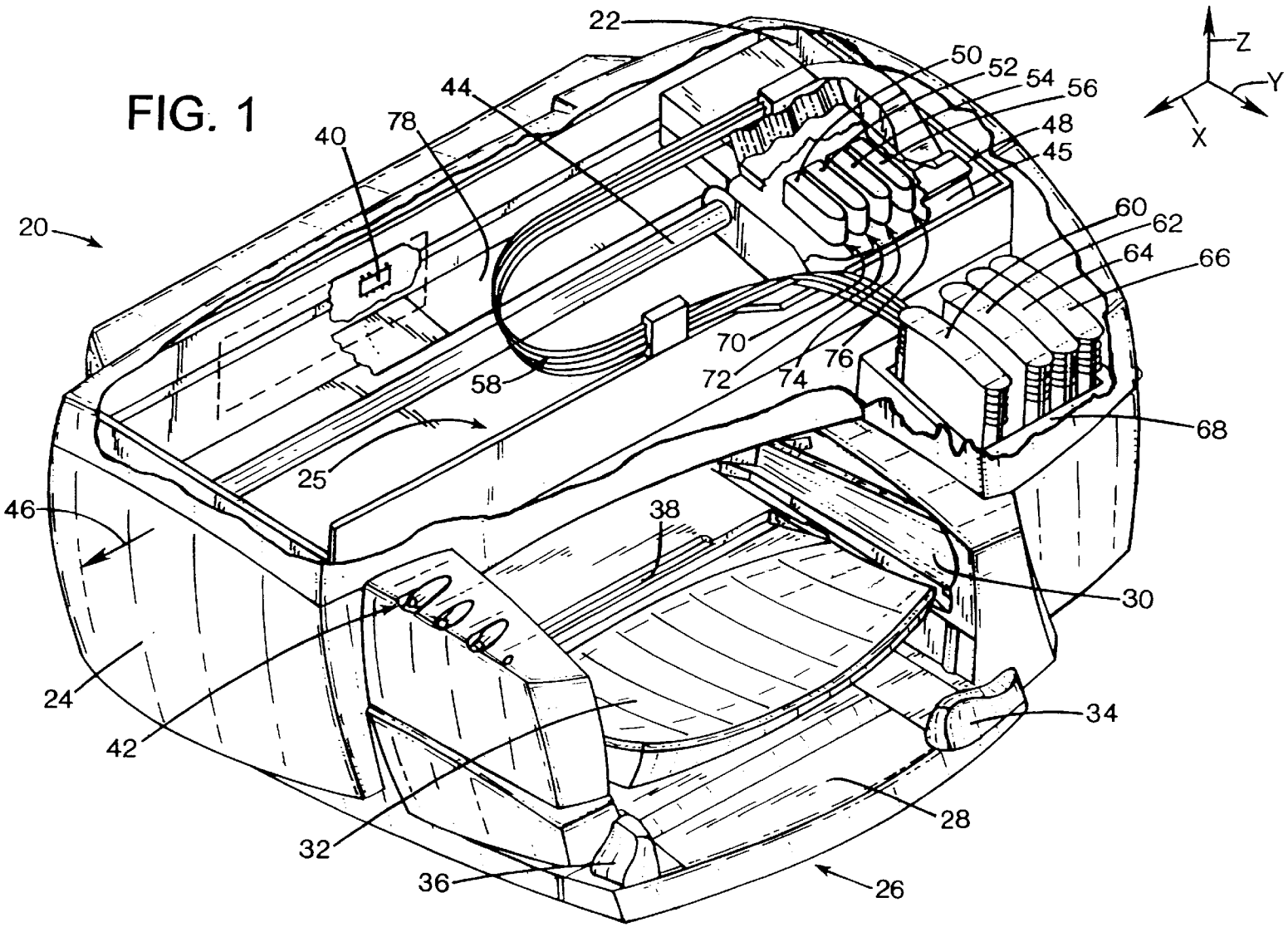
FIG. 1 is a perspective view of one form of an inkjet printing mechanism, here, an inkjet printer, including a printhead service station having one form of a unitary capping system of the present invention for simultaneously sealing multiple inkjet printheads.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional motor-driven paper drive rollers (not shown) may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). The printer controller 40 may also operate in response to user inputs provided through a key pad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slideably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional motor assembly may be coupled to drive an endless belt (not shown), which may be secured in a conventional manner to the carriage 45, with the motor operating in response to control signals received from the controller 40 to incrementally advance the carriage 45 along guide rod 44. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

Figure 2:
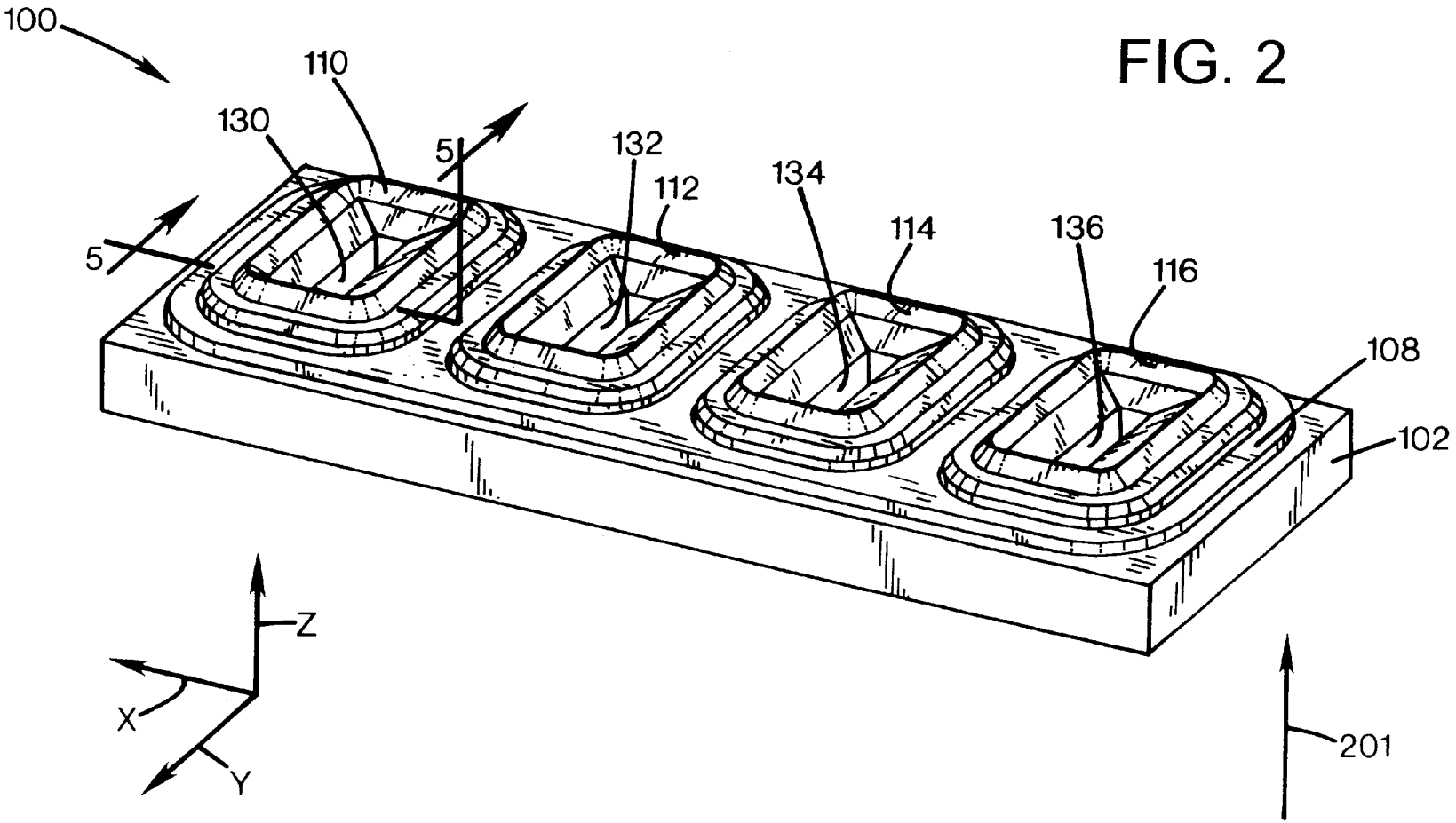
FIG 2 is an enlarged, top perspective view of the unitary capping system of FIG. 1.

In the printzone 25, the media sheet 34 receives ink from an inkjet cartridge, such as a black ink cartridge 50 and three monochrome color ink cartridges 52, 54 and 56, shown schematically in FIG. 2. The cartridges 50–56 are also often called "pens" by those in the art. The black ink pen 50 is illustrated herein as containing a pigment-based ink. While the illustrated color pens 52–56 may contain pigment-based inks, for the purposes of illustration, color pens 52–56 are described as each containing a dye-based ink of the colors cyan, magenta and yellow, respectively. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46. Hence, the replaceable cartridge system may be considered as an "on-axis" system, whereas systems which store the main ink supply at a stationary location remote from the printzone scanning axis are called "off-axis" systems. In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to form an image on a sheet of media in the printzone 25. The printheads 70, 72, 74 and 76 each have an orifice plate with a plurality of nozzles formed therethrough in a manner well known to those skilled in the art. The nozzles of each printhead 70-76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

Unitary Capping System

FIGS. 2–5 illustrate one form of a unitary capping system 100 constructed in accordance with the present invention and installed in the servicing region 48 within the printer casing 24. The unitary capping system 100 may be moved between a sealing position (FIG. 5) and a rest position by a variety of different mechanisms known to those skilled in the art. Indeed, many different approaches have been used to move printhead servicing implements into engagement with their respective printheads. For example, a dual (two) printhead servicing mechanism which moves the caps in a perpendicular direction toward the orifice plates of the printheads is shown in U.S. Pat. No. 5,155,497, assigned to the present assignee, Hewlett-Packard Company, of Palo Alto, Calif. Another dual printhead servicing mechanism uses the carriage to pull the caps laterally up a ramp and into contact with the printheads, as shown in U.S. Pat. No. 5,440,331, also assigned to the Hewlett-Packard Company. Examples of a quad (four) pen capping systems that use a translational motion are seen in several other commercially available printers produced by the Hewlett-Packard Company, including the DeskJet® 1200 and 1600 models.

Another earlier capping system using a translational (sliding) platform to support the cap sled to seal two printheads is commercially available in the DeskJet® 720C and 722C models of inkjet printers produced by the Hewlett-Packard Company, with a similar capping mechanism being used in the Hewlett-Packard Company's PhotoSmart® color inkjet printer. One other earlier capping system, using a tumbler to support the cap sled to seal two printheads, has been sold in several models of printers produced by the Hewlett-Packard Company, including the DeskJet® 850C, 855C, 820C, 870C, 890C and 895C model inkjet printers. In both the tumbler and sliding platform systems, the cap sled is attached to the tumbler and platform to rock upward into a printhead sealing position as the tumbler and platform move after a portion of the sled has contacted either the printhead or the printhead carriage. In both of these systems, a coil spring is inserted between the sled and the tumbler or platform to push the caps into contact with the printhead. This rocking motion to seal the printheads, using either a rotary or sliding platform, is one preferred manner of installing the unitary capping system 100 in printer 20, while another preferred manner of installing the unitary capping system 100 is seen in the DeskJet® 2000C model color inkjet printer, an off-axis printer, which uses both rotary and translational motion to move printhead servicing implements between rest and servicing positions. Thus, it is apparent that a variety of different mechanisms and angles of approach may be used to physically move the caps into a sealing position of engagement with the printheads, as illustrated by arrow 201 in FIGS. 2–4.

Figure 3:
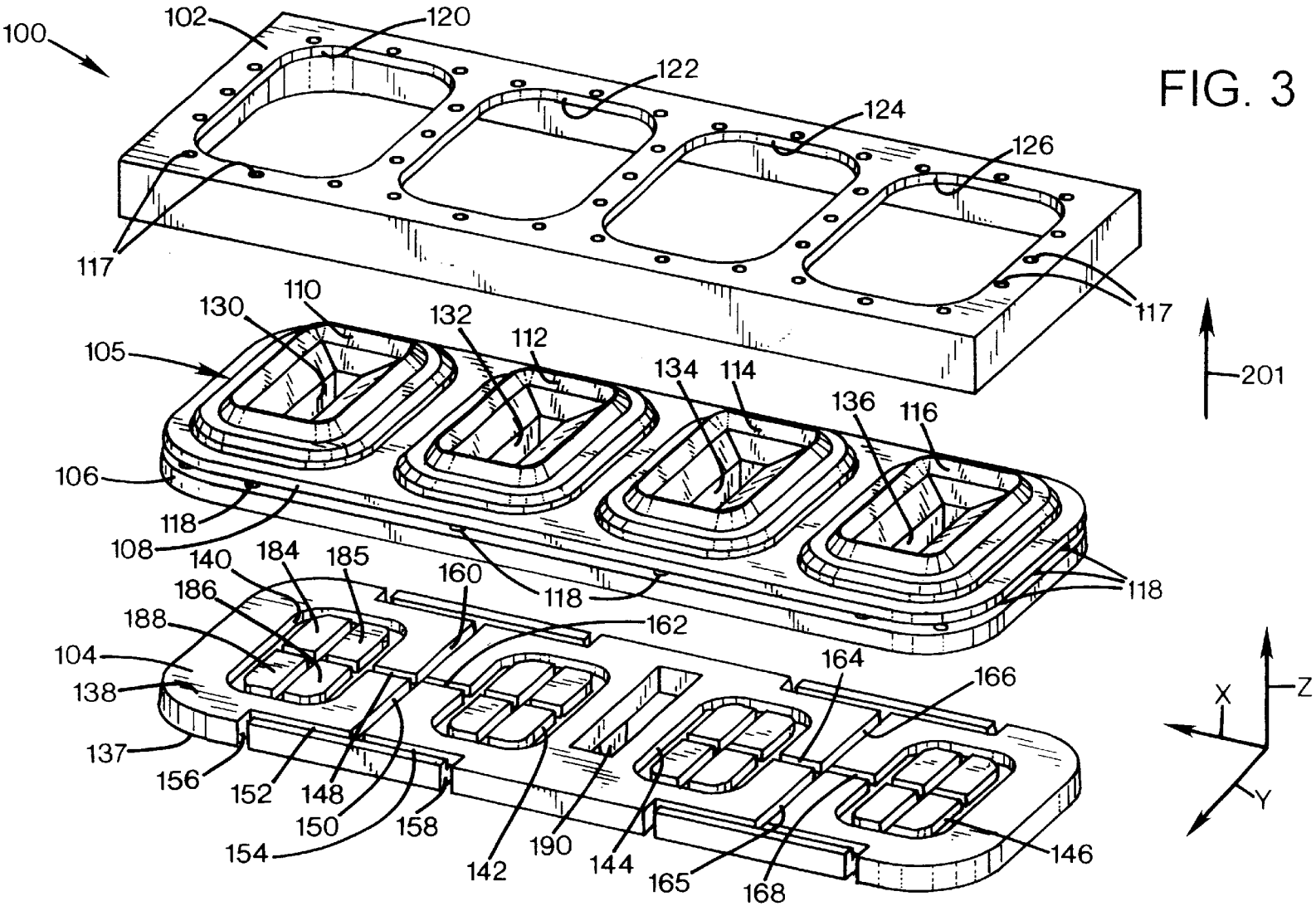
FIG. 3 is an enlarged, exploded, top perspective view of the capping system of FIG. 2.
Figure 4:
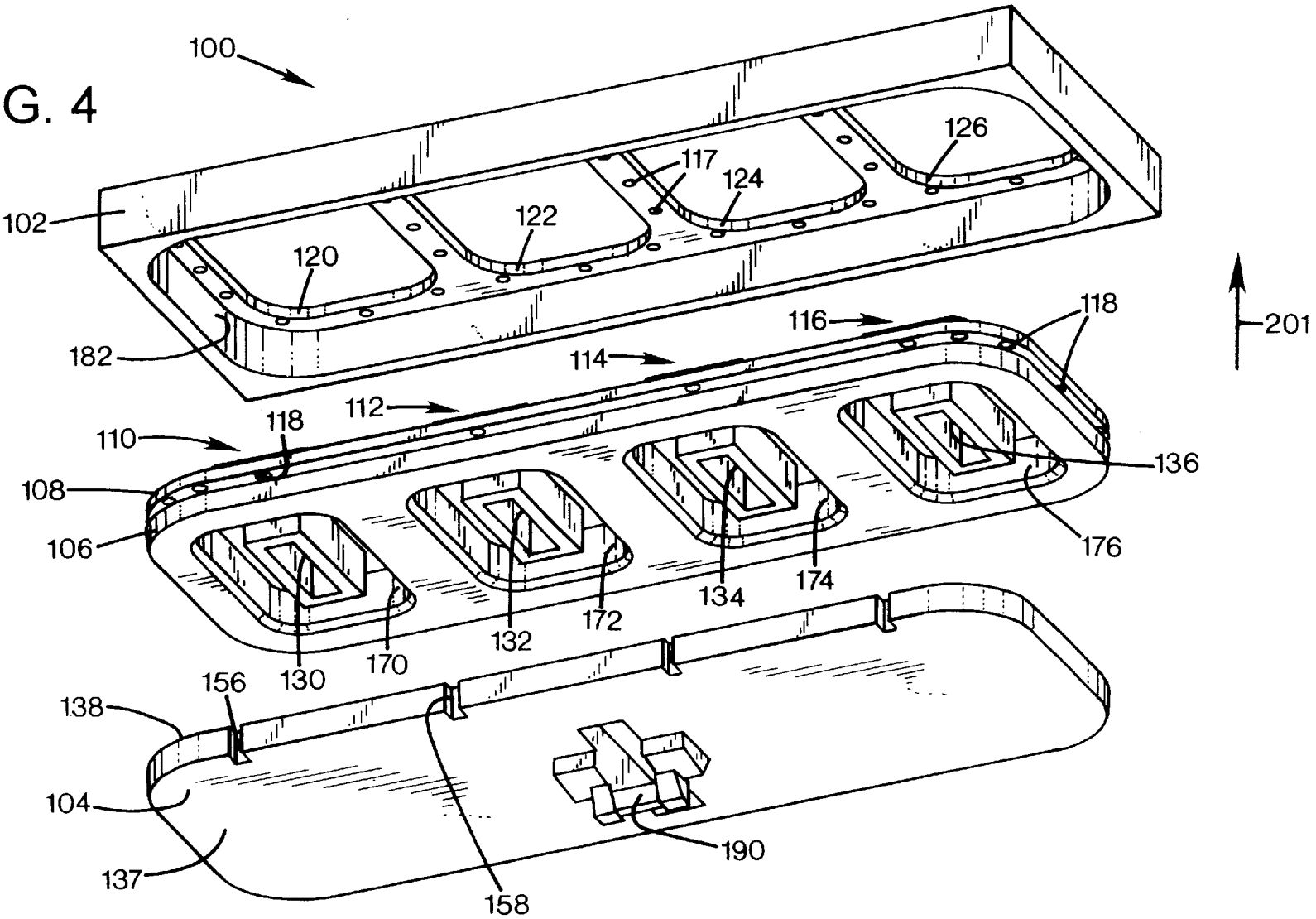
FIG. 4 is an enlarged, exploded, bottom perspective view of the capping system FIG. 2
Figure 5:
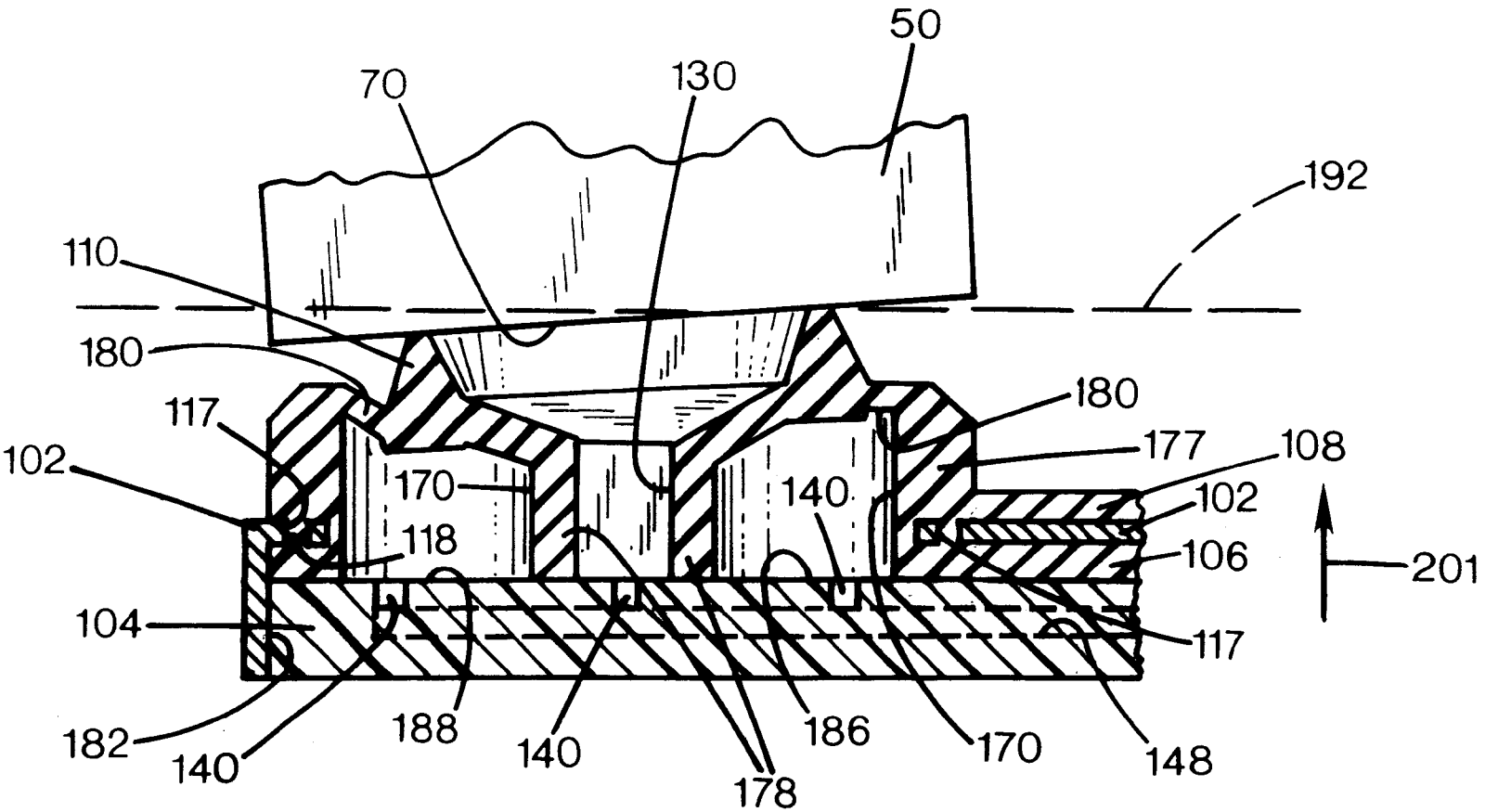
FIG. 5 is an enlarged, side elevational view of the capping system of FIG. 2, taken along lines 5—5 thereof, shown sealing one of the multiple printheads.

Returning to the unitary capping system 100 of FIGS. 2–5, the system 100 includes a base member 102, a combination sled and vent path member 104, and a resilient, elastomeric printhead sealing structure or lip assembly 105, which is onsert molded over the base 102. The lip assembly 105 has a lower web portion 106 and an upper web portion 108. Projecting upwardly from the upper web 108 are a series of four suspended lip cap structures 110, 112, 114 and 116, each of which surround the nozzles and form a hermetic seal at the orifice plates of printheads 70, 72, 74 and 76, respectively, when moved into a servicing position, as shown in FIG. 5 for lip 110 sealing printhead 70. The base 102 defines a series of knit holes 117 therethrough, which are used during the onsert molding process to permanently attach the lip assembly 105 to the base. During molding, the elastomer material of the lip assembly 105 flows through the knit holes 117 to form a series of knit points 118 which join the lower and upper webs 106, 108 together with the base 102 sandwiched between webs 106, 108. Preferably, the lip assembly 105 is constructed of a flexible, resilient, non-abrasive, elastomeric material, such as nitrile rubber, or more preferably, ethylene polypropylene diene monomer (EPDM), or other comparable materials known in the art.

The base 102 also defines a group of cap holes 120, 122, 124 and 126 therethrough. Each cap structure 110, 112, 114 and 116 also defines a central vent passageway or throat 130, 132, 134 and 136 which extends downwardly through the cap holes 120, 122, 124 and 126 in base 102. The sled 104 has a lower surface 137 and an upper flat or planar surface 138. As best shown in FIG. 3, the sled upper surface 138 defines a series of vent passageways or diffusion paths 140, 142, 144 and 146 which are in fluid communication with the cap vent throats 130, 132, 134 and 136, respectively. While the sled vent paths 140, 142, 144 and 146 may be formed in different patterns, in the illustrated embodiment, the passageways 140-146 are constructed in substantially the same shape. The vent path 140 is coupled by an intermediate passageway 148 to a final T-shaped vent passageway 150 which includes a lateral passageway 152 having opposing ends that extend downwardly at the periphery of the sled 104 from the upper surface 138 to terminate at the sled lower surface 137 at outlet ports 156 and 158. The cap sled 104 also defines a second T-shaped final vent passageway 160, which may have the same construction as described for the final vent 150, and which is preferably fluidically coupled with vent 150.

In the past, each cap has had a separate vent to prevent any cross contamination of the ink colors, as well as to prevent plugging of the vent path from mutually coagulating, precipitating or otherwise incompatible inks. The illustrated venting scheme advantageously allows the caps to share a common vent path, here, with a pair of caps, such as caps 110 and 112, sharing the final T-shaped vent paths 150 and 160. The vent path 142 is coupled to the T-shaped paths 150 and 160 by an intermediate or linking passageway 162. The cap sled 104 also defines an intermediate passageway 164 which links the vent path 144 to a pair of T-shaped final vent paths 165 and 166, which may be constructed as described above for the T-shaped path 150. The last cap vent 146 is linked to the T-shaped vent paths 165 and 166 by another intermediate passageway 168 to share the paths 165, 166 with cap vent 144.

As shown in FIG. 4, underneath each cap lip 110, 112, 114 and 116 is an empty, open, hollow deflection channel 170, 172, 174 and 176, respectively, each of which have substantially the same construction. When assembled with the cap assembly 105 resting against the sled 104, deflection cavities are then defined between each channel 170, 172, 174 and 176 and the planar sled upper surface 138, so no portion of the sled 104 extends into these deflection cavities. The upper surface of the lip assembly 105, opposite each channel 170, 172, 174 and 176 defines a lip support structure, which is then hollow since no portion of the sled 104 extends into the channels 170–176. As illustrated in FIG. 5 for the black cap structure 110, the channel 170 is defined by a cap exterior or peripheral wall 177, and an interior vent throat wall 178, which also defined the vent throat 130. The exterior wall 177 and the interior wall 178 form the upright supports of the bridge-like structure across which a suspension portion or bridge 180 of the cap is suspended. The sealing lip 110 projects upwardly from the bridge 180 to seal the printhead 70 when the cap 110 is moved in the direction of arrow 201 into a sealing position, as shown in FIG. 5.

The base 102 has a recessed undersurface that defines a sled receiving chamber 182. The sled chamber 182 is sized to receive the sled 104 with a press fit, although in some implementations, it may be preferable to include a mechanical fastener or latching mechanism, such as a snap fit, between the base 102 and the sled 104. The undersurface of the base 102 that defines chamber 182 also serves to enclose the intermediate vent paths 148, 162, 164 and 168, and the T-shaped final vent paths 150, 160, 165 and 166 when assembled, leaving the vent outlet ports, such as ports 156 and 158, open to atmosphere. When assembled, the hollow deflection channel 170 straddles the rectangular periphery of the vent path 140, with the lower surface of the vent throat wall 178 resting firmly against segments 184, 185, 186 and 188 of the sled upper surface 138 (see FIGS. 3 and 5). The bottom opening of the throat 130 sits over the intersection portion of vent path 140 which separates the segments 184, 185, 186 and 188 from one another. The length and area of the vents paths, from the printhead 70 to the outlet ports 156, 158 may be varied as know by those skilled in the art, depending on the particular printhead geometries, sealing characteristics, etc. desired.

As mentioned near the beginning of this section, a variety of different mechanisms may be used to move the cap in the direction of arrow 201 into a sealing position, or in the general direction opposite arrow 201 to a rest position out of engagement with the printhead 70, such as during printing or other printhead servicing operations. The sled 104 may be secured to the operating mechanism by way of an attachment member 190 extending downwardly from the sled lower surface 137, as best shown in FIG. 4.

FIG. 5 shows cap 110 sealing printhead 70, which is slightly misaligned with respect to a nominal printhead plane 192, shown in dashed lines. Here, the left side of the black printhead 70 dips below the reference plane 192, and is sealed without experiencing excessive capping forces as the suspension bridge portion 180 to the left of center of the cap structure is deflected into the empty channel 170. The various reasons and causes for such printhead misalignment are discussed in the Background section above.

Figure 6:
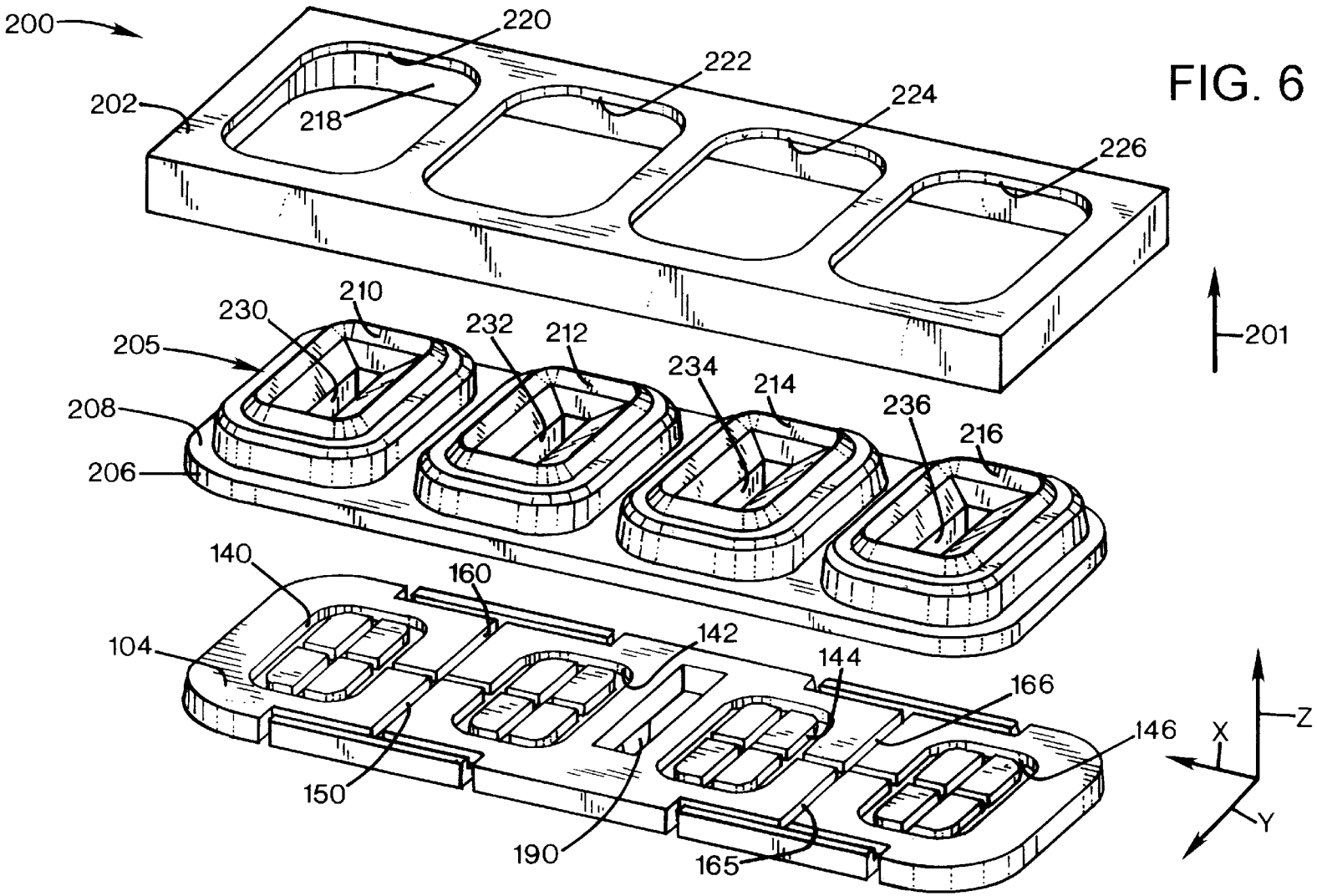
FIG. 6 is an enlarged, exploded, top perspective view of an alternate embodiment of the unitary capping system of FIG. 1.

FIG. 6 shows an alternative embodiment of a unitary capping system 200 constructed in accordance with the present invention, which may be substituted for the capping system 100. Rather than being an onsert molded design, system 200 uses the combination sled and vent path member 104 described above, in conjunction with a covering base member 202 and a flexible lip assembly 205 which is sandwiched between the sled 104 and cover 202. The lip assembly 205 has a web 206 with an upper surface 208 from which project four suspended lip cap structures 210, 212, 214 and 216. The cover base 202 also defines a group of cap holes 220, 222, 224 and 226 through which the cap lips 210, 212, 214 and 216 project. The cover base 202 has a recessed undersurface that defines a sled receiving chamber 218 that may be sized to receive the sled 104 with a press fit, with or without additional latches, hooks or other fitments, as discussed above with respect to base 102 and chamber 182. Each cap structure 210, 212, 214 and 216 also defines a central vent passageway or throat 230, 232, 234 and 236 which extends downwardly through holes 220, 222, 224 and 226 in cover 202. Each cap structure 210–216 may be substantially the same as described above for the caps 110–116, including the hollow deflection channel 170, and the fit of each cap with respect to the vent paths 140-146 defined by the sled 104.

Conclusion

A variety of advantages are realized using the unitary capping systems 100 and 200 described herein, and several of these advantages have been noted above. For example, this unitary capping system 100, 200 has been found to reduce the sealing forces exerted on printheads 70–76. Also, assembly costs are lowered compared to earlier systems due to the decreased part count and the elimination of the chimney. Moreover, if some designs favor the onsert molded design 100 over the press-fit design 200, the sled 104 may be easily used with either design 100, 200. Indeed, as further modifications of the press-fit design 200, in one embodiment the covering base 202 may be eliminated by configuring the lip assembly web 206 to have a downwardly protruding gripping ridge around the periphery of the web, sized to define a sled-receiving chamber similar to chamber 218, with the gripping ridge resiliently holding the sled 104 within this chamber. Alternatively, the sled 104 may have lip assembly retaining features, such as an upwardly extending gripping ridge extending around the periphery of the sled so web 206 may be press-fit under this gripping ridge and retained thereby along the upper planar surface of the sled.

As mentioned in the Background section above, U.S. Pat. No. 5,448,270, assigned to the Hewlett-Packard Company, the present assignee, disclosed a suspended lip cap design, with each cap being separately press-fit over a positioning race or boss, sometimes referred to as a "chimney." Commercial embodiments of this suspended lip design were sold in the DeskJet® 1200 and 1600 model inkjet printers, by the Hewlett-Packard Company. In this earlier suspended lip cap design, with each cap was separately press-fit over a positioning race or boss, sometimes referred to as a "chimney," which projected upwardly from the sled. In this earlier design, the boss used to support the caps was a necessary evil believed to be required to ensure proper printhead sealing forces, diffusion path resistance and venting, as well as to properly locate the lip around the printhead nozzles.

Given the difficulty of assembly, and resulting increased cost of the product, the inventor began a study of the sealing ability of the unitary cap systems 100, 200 described above, and compared their performance to that of the caps sold in the DeskJet® 1200, 1600 and 2000C model inkjet printers. Surprisingly, the web 106, 108 and 206 gave the caps 110–116, 210–216 lateral stability, while the smooth fit of the vent throat wall 178 against the segments 184, 185, 186 and 188 of the sled upper surface 138 provided good support for the throat wall 178. The illustrated cap geometry for systems 100 and 200 offered a larger operating range to accommodate tolerance stack than a mere compressed elastomer, such as in the DeskJet® 2000C model inkjet printer which required each cap to be separately gimbaled. Moreover, it was discovered that the chimneyless unitary cap system 100, 200 performed comparably with the earlier chimney designs in the DeskJet® 1200 and 1600 model inkjet printers, with the illustrated geometry of the caps 110–118, 210–218 being more important to performance than the durometer (relative hardness) of the cap elastomer, or the type of materials selected. Thus, manufacturing costs are lower because the tolerances on the material durometer could now be increased without sacrificing performance.

I claim:

1. A unitary capping system for sealing ink-ejecting nozzles of an inkjet printhead in an inkjet printing mechanism, comprising:

a base defining a chamber, with the base defining a cap hole therethrough;

a sled received within the base chamber, with the sled having an upper planar surface, and with the sled moving between a sealing position and a rest position; and an elastomeric printhead sealing structure including a planar web sandwiched between the sled and the base inside the chamber, a hollow lip support surrounded by the web and having an upper surface extending through the cap hole to encircle the printhead nozzles, and a lip supported by the lip support upper surface to surround the nozzles when the sled is in the sealing position;

wherein the hollow lip support and web each have a lower surface that rests against the upper planar surface of the sled.

2. A unitary capping system according to claim 1 wherein:

the sealing structure defines a vent throat extending therethrough and being surrounded by the hollow lip support; and the sled defines a vent path having an entrance in fluid communication with the vent throat and an exit port to vent to atmosphere.

3. A unitary capping system according to claim 1 for sealing ink-ejecting nozzles of plural inkjet printheads in the inkjet printing mechanism, wherein:

the base defines plural cap holes extending therethrough;

the sealing structure includes plural hollow lip supports surrounded by the web, with each lip support having an upper surface extending through an associated one of the plural cap holes to encircle the nozzles of an associated one of the printheads, and plural lips supported by an upper surface of an associated one of the lip supports to surround the nozzles of an associated one of the printheads when the sled is in the sealing position, with the sealing structure defining plural vent throats extending therethrough and being surrounded by an associated one of the hollow lip supports; and the sled defines a vent path having an entrance in fluid communication with the vent throat, an exit port to vent to atmosphere, and a common passageway shared between at least two of the vent throats.

4. A unitary capping system according to claim 1 wherein:

said web of the sealing structure comprises a lower web;

the sealing structure further includes an upper web; and the base is sandwiched between the upper and lower webs.

5. A unitary capping system according to claim 4 wherein the base is an insert member, and the sealing structure is onsert molded over the base.

6. An inkjet printing mechanism, comprising:

an inkjet printhead having ink-ejecting nozzles;

a carriage that reciprocates the printhead through a print-zone for printing and to a servicing region for printhead servicing; and a unitary capping system in the servicing region for sealing the nozzles of the inkjet printhead, with the unitary capping system comprising:

a base defining a chamber, with the base defining a cap hole therethrough;

a sled received within the base chamber, with the sled having an upper planar surface, and with the sled moving between a sealing position and a rest position; and an elastomeric printhead sealing structure including a planar web sandwiched between the sled and the base inside the chamber, a hollow lip support surrounded by the web and having an upper surface extending through the cap hole to encircle the printhead nozzles, and a lip supported by the lip support upper surface to surround the nozzles when the sled is in the sealing position;

wherein the hollow lip support and web each have a lower surface that rests against the upper planar surface of the sled.

7. An inkjet printing mechanism according to claim 6 wherein: the sealing structure defines a vent throat extending therethrough and being surrounded by the hollow lip support; and the sled defines a vent path having an entrance in fluid communication with the vent throat and an exit port to vent to atmosphere.

8. An inkjet printing mechanism according to claim 6 wherein:

said web of the sealing structure comprises a lower web;

the sealing structure further includes an upper web; and the base is sandwiched between the upper and lower webs.

9. An inkjet printing mechanism according to claim 8 wherein the base is an insert member, and the elastomeric lip assembly is onsert molded over the base.

10. An inkjet printing mechanism according to claim 6 wherein:

the printing mechanism further includes plural inkjet printheads reciprocated by the carriage;

the base defines plural cap holes extending therethrough;

the sealing structure includes plural hollow lip supports surrounded by the web, with each lip support having an upper surface extending through an associated one of the plural cap holes to encircle the nozzles of an associated one of the printheads, and plural lips supported by an upper surface of an associated one of the lip supports to surround the nozzles of an associated one of the printheads when the sled is in the sealing position, with the sealing structure defining plural vent throats extending therethrough and being surrounded by an associated one of the hollow lip supports; and the sled defines a vent path having an entrance in fluid communication with the vent throat, an exit port to vent to atmosphere, and a common passageway shared between at least two of the vent throats.

11. An inkjet printing mechanism according to claim 10 further including:

plural stationary main reservoirs containing ink for an associated one of the plural inkjet printheads; and an ink delivery system that supplies ink from the plural stationary main reservoirs to an associated one of the plural inkjet printheads.

12. A unitary capping system for sealing ink-ejecting nozzles of plural inkjet printheads in an inkjet printing mechanism, comprising:

a base having an exterior surface and an interior surface defining a chamber, with the base defining plural cap holes therethrough;

a sled received within the base chamber, with the sled having an upper planar surface, and with the sled moving between a sealing position and a rest position; and an elastomeric lip assembly having a lower surface and an upper surface, with the lip assembly including:

(a) a web located inside the chamber between the base and the sled, and (b) plural printhead sealing structures joined together by the web, with each printhead sealing structure comprising:

(i) a hollow support projecting through an associated one of the plural cap holes of the base, with said hollow support having:

(1) an interior wall having a lower surface resting on the sled upper planar surface, (2) an exterior wall having a lower surface resting on the sled upper planar surface, and (3) a suspension wall suspended between the interior and exterior walls to define a hollow channel along the lower surface of the lip assembly, and (ii) a sealing lip projecting upwardly from the upper surface of the suspension wall to surround the ink-ejecting nozzles of an associated one of the plural printheads when the sled is in the sealing position, with the interior wall and the exterior wall of each hollow support having a lower surface resting on the sled upper planar surface.

13. A unitary capping system according to claim 12 wherein:

the interior wall of each printhead sealing structure defines a vent throat extending through the elastomeric lip assembly from the upper surface to the lower surface thereof; and the sled defines a vent path having an entrance in fluid communication with the vent throat of each printhead sealing structure and an exit port to vent to atmosphere.

14. A unitary capping system according to claim 13 wherein the vent path defined by the sled has a common passageway shared between the vent throats of at least two of the plural printhead sealing structures and at least one exit port.

15. A unitary capping system according to claim 12 wherein:

said web of the elastomeric lip assembly comprises a lower web;

the elastomeric lip assembly further includes an upper web; and the base is sandwiched between the upper and lower webs of the elastomeric lip assembly.

16. A unitary capping system according to claim 15 wherein the base is an insert member, and the elastomeric lip assembly is onsert molded over the base.

17. A unitary capping system for sealing ink-ejecting nozzles of plural inkjet printheads in an inkjet printing mechanism, comprising:

a sled moveable between a sealing position and a rest position, with the sled having a planar surface;

an elastomeric printhead sealing structure supported by the sled and having plural lip supports each of which is associated with one of the plural inkjet printheads, with each lip support having opposing first and second surfaces with a sealing lip projecting from the first surface thereof and configured to surround the nozzles of an associated printhead when the sled is in the sealing position, with the second surface of each lip support and the sled planar surface defining a deflection cavity therebetween into which a portion of the lip support may collapse when sealing the associated printhead; and a rigid base member supported by the sled with a portion of the elastomeric printhead sealing structure being sandwiched therebetween.

18. A unitary capping system according to claim 17 wherein said base member comprises an insert member, and the elastomeric printhead sealing structure is onsert molded onto the base member.

19. A unitary capping system according to claim 17 wherein:

the elastomeric printhead sealing structure includes a web member joining together the said plural lip supports; and the base member overlies at least a portion of the web member.

* * * * *